US007758347B2

(12) United States Patent
Sasaki

(10) Patent No.: US 7,758,347 B2
(45) Date of Patent: Jul. 20, 2010

(54) COLOR SIMULATION SYSTEM FOR HAIR COLORING

(75) Inventor: Daisuke Sasaki, Tokyo (JP)

(73) Assignee: Wella AG, Darmstadt (DE)

( * ) Notice: Subject to any disclaimer, the term of this patent is extended or adjusted under 35 U.S.C. 154(b) by 10 days.

(21) Appl. No.: 10/591,013

(22) PCT Filed: Jan. 29, 2005

(86) PCT No.: PCT/EP2005/000892

§ 371 (c)(1),
(2), (4) Date: Aug. 29, 2006

(87) PCT Pub. No.: WO2005/089589

PCT Pub. Date: Sep. 29, 2005

(65) Prior Publication Data

US 2007/0184415 A1 Aug. 9, 2007

(30) Foreign Application Priority Data

Mar. 24, 2004 (JP) ..... 2004-087602

(51) Int. Cl.
*G09B 19/10* (2006.01)

(52) U.S. Cl. ..... 434/94; 434/98; 434/100; 434/81; 345/591; 345/592; 345/593; 345/594

(58) Field of Classification Search ..... 434/94, 434/100, 377; 8/405; 345/591, 592, 593, 345/639

See application file for complete search history.

(56) References Cited

U.S. PATENT DOCUMENTS 4,524,421 A * 6/1985 Searby et al. ..... 345/594
5,254,978 A * 10/1993 Beretta ..... 345/601
5,432,896 A * 7/1995 Hwong et al. ..... 345/592
5,552,805 A * 9/1996 Alpher ..... 345/597
5,999,190 A * 12/1999 Sheasby et al. ..... 345/589
6,028,583 A * 2/2000 Hamburg ..... 345/629
6,072,501 A * 6/2000 Bier ..... 345/629
6,330,002 B1 * 12/2001 Yamada ..... 345/629
6,342,882 B1 * 1/2002 Oka ..... 345/419
6,707,929 B2 * 3/2004 Marapane et al. ..... 382/100

(Continued)

FOREIGN PATENT DOCUMENTS

EP 1 147 722 10/2001

(Continued)

*Primary Examiner*—Cameron Saadat
*Assistant Examiner*—Bruk A Gebremichael
(74) *Attorney, Agent, or Firm*—Michael J. Striker

(57) ABSTRACT

The hair color simulation system for simulating a dyed hair color that results from dyeing hair with a mixture of two hair color preparations includes a base screen with a first through fifth layers and an intermediate layer. The first through fifth layers and the intermediate layer are superimposed over one another so as to display a simulated hair color that is produced when the first hair line, the second hair line, the colors of the two hair color preparations and the original hair color are displayed on the layers with respective transparencies and superimposed over each other. The RGB values of the superimposed colors produced by the two hair color preparations and the original hair color are stored in data storage sections. Input sections receive choices of the two hair color preparations and a mixing ratio for the simulation.

5 Claims, 3 Drawing Sheets

U.S. PATENT DOCUMENTS

| | | | | |
|---|---|---|---|---|
| 6,717,673 | B1 * | 4/2004 | Janssen et al. | 356/402 |
| 6,876,360 | B2 * | 4/2005 | Sasaki | 345/422 |
| 6,937,755 | B2 * | 8/2005 | Orpaz et al. | 382/162 |
| 6,980,888 | B2 * | 12/2005 | Baker et al. | 700/236 |
| 7,006,657 | B2 * | 2/2006 | Bazin | 382/100 |
| 7,079,158 | B2 * | 7/2006 | Lambertsen | 345/630 |
| 7,245,306 | B2 * | 7/2007 | Yoshio et al. | 345/591 |
| 2001/0030654 | A1 * | 10/2001 | Iki | 345/629 |
| 2002/0005855 | A1 * | 1/2002 | Mehigan | 345/596 |
| 2002/0054039 | A1 * | 5/2002 | Lei et al. | 345/419 |
| 2002/0090123 | A1 * | 7/2002 | Bazin | 382/128 |
| 2002/0118218 | A1 * | 8/2002 | Voticky et al. | 345/629 |
| 2002/0122036 | A1 * | 9/2002 | Sasaki | 345/422 |
| 2002/0149600 | A1 * | 10/2002 | Van Splunter et al. | 345/592 |
| 2002/0150287 | A1 * | 10/2002 | Kobayashi | 382/154 |
| 2002/0167527 | A1 * | 11/2002 | Senn et al. | 345/592 |
| 2004/0024758 | A1 * | 2/2004 | Iwasaki | 707/3 |
| 2005/0228538 | A1 * | 10/2005 | Limburger | 700/239 |

FOREIGN PATENT DOCUMENTS

| | | |
|---|---|---|
| EP | 1 221 293 | 7/2002 |
| JP | 09204138 | 8/1997 |
| JP | 2000231623 | 8/2000 |
| WO | 03/020072 | 3/2003 |

* cited by examiner

COLOR SIMULATION SYSTEM FOR HAIR COLORING

CROSS-REFERENCE

This is the US National Stage of PCT/EP 2005/000892, which was filed in Europe on Jan. 29, 2005. The invention described herein below is also described in Japanese Patent Application No. 2004-087602, which was filed on Mar. 24, 2004, in Japan. The aforesaid Japanese Patent Application provides the basis for a claim of priority of invention for the invention described herein below under 35 U.S.C. 119 (a) to (d) and 365.

BACKGROUND OF THE INVENTION

1. Field of the Invention

The present invention relates to a color simulation system for performing a simulation to check a hair color that is expected as a result of application of hair color preparations to the original hair of a client, prior to a hair coloring operation.

2. Description of the Related Art

In recent years, an increasing number of people enjoy having their hair colored in desired colors that coordinate with the colors of their makeup or clothes. When hair coloring is performed, however, the resultant hair color is different from the color of a hair color preparation used for the hair coloring, because the resultant color greatly depends on the general characteristics of the hair such as the thickness and hardness of the hair, and the original color of the hair before the hair coloring.

At a beauty salon, a hair stylist normally provides counseling to each client before a hair coloring operation, so as to minimize the difference between the color desired by the client and the resultant color expected from experience by the hair stylist. However, hair colors one would picture in mind are very subjective and are very hard to put into words. To counter this problem, Japanese Laid-Open Patent Publication No. 204138 of 1997 discloses a device that shows the images of estimated hair colors to a hair stylist and his/her client, so that the hair stylist can provide smooth counseling based on the estimated images.

Meanwhile, a method called "hair color mixing" has been becoming popular recently in response to various consumer demands for hair colors. According to the hair color mixing method, two different hair color preparations are mixed and then applied to hair. By this method, however, it is even more difficult to color the hair of a client as desired, than in the conventional case where only one hair color preparation is used. Therefore, it is necessary to carefully and accurately provide counseling so as to reduce the difference between the resultant color desired by the client and the resultant color expected by the hair stylist.

In the case of a hair coloring operation to be performed by the hair color mixing method, however, there has not been a suitable technique developed for providing smooth counseling to a client so as to clearly show the client the resultant hair color expected by the hair stylist.

SUMMARY OF THE INVENTION

It is, therefore, an object of the present invention to provide a means for performing an accurate hair coloring operation with mixed hair color preparations, so as to minimize the difference between the hair color desired by a client and the resultant hair color expected by a hair stylist.

To solve the above problem, the present invention provides a color simulation system that includes: a display section; a base screen displaying section that displays a base screen on the predetermined display area of the display section, the base screen having first through fifth layers; a hair color data storage section that records the RGB value of each of original hair colors to be subjected to hair coloring; a hair color preparation data storage section that records the RGB value of each of the colors of hair color preparations; a hair line data storage section that records the image data of a hair line; a first input section that receives an input of choice of one hair color from the original hair colors recorded in the hair color data storage section; a second input section that receives an input of choice of two hair color preparations from the data of the hair color preparations recorded in the hair color preparation data storage section together with a mixing ratio between the selected hair color preparations; a first image displaying section that displays the hair line with predetermined transparency on the first layer of the base screen according to the image data recorded in the hair line data storage section; a second image displaying section that retrieves the RGB value of a selected hair color from the hair color data storage section and displays the selected hair color without transparency on the fifth layer of the base section based on the input received at the first input section; a third image displaying section that retrieves the RGB values of the selected two hair color preparations from the hair color preparation data storage section and displays the colors of the selected two hair color preparations with predetermined transparency on the third and fourth layers of the base screen, respectively based on the input received at the second input section, the predetermined transparency corresponding to the mixing ratio between the two hair color preparations; and a fourth image displaying section that retrieves the RGB value of the selected hair color from the hair color data storage section and displays the selected hair color with predetermined transparency on the second layer of the base screen based on the input received at the first input section.

In the above described structure, the base screen displayed by the base screen displaying section preferably has an intermediate layer between the first and second layers, and the color simulation system further includes a second hair line data storage section that records the image data of a second hair line which is different from the hair line recorded in the hair line data storage section in line pattern and color, and a fifth image displaying section that displays the second hair line with predetermined transparency on the intermediate layer of the base screen according to the image data recorded in the second hair line data storage section.

More preferably, the third image displaying section displays the selected two hair color preparations in the colors which are deeper than the original colors thereof recorded in the hair color preparation data storage section by a predetermined RGB value and with the transparency corresponding to the mixing ratio between the two hair color preparations.

Also, the third image displaying section preferably displays the color of one of the selected two hair color preparations on the third layer with the transparency which is lower than the transparency determined by the mixing ratio, and the color of the other one of the selected two hair color preparations on the fourth layer with the transparency which is higher than the transparency determined by the mixing ratio.

Further, the display area of the display section is preferably the hair region on the head of a model displayed by the display section.

According to the present invention, a screen with a layered structure is prepared, and a hair line image and the original color of the hair to be subjected to hair coloring are displayed with predetermined transparency on the corresponding layers of the screen. Also, the colors of two hair color preparations to be mixed with each other are displayed with the transparency corresponding to the mixing ratio between the two hair color preparations on the corresponding layers. These layers are then superimposed on one another so as to display the image of the hair in a color with the feel that is very close to the actual resultant color of the hair subjected to the hair coloring.

In this manner, a hair coloring simulation can be performed with the system according to the present invention, while the color of hair is being monitored on the screen. Through the hair coloring simulation, the difference between the color desired by the client and the resultant color expected by the hair stylist can be made as small as possible. Thus, more accurate hair coloring can be performed.

DESCRIPTION OF THE PREFERRED EMBODIMENTS

The following is a description of embodiments of the present invention, with reference to the accompanying drawings.

Figure 1:
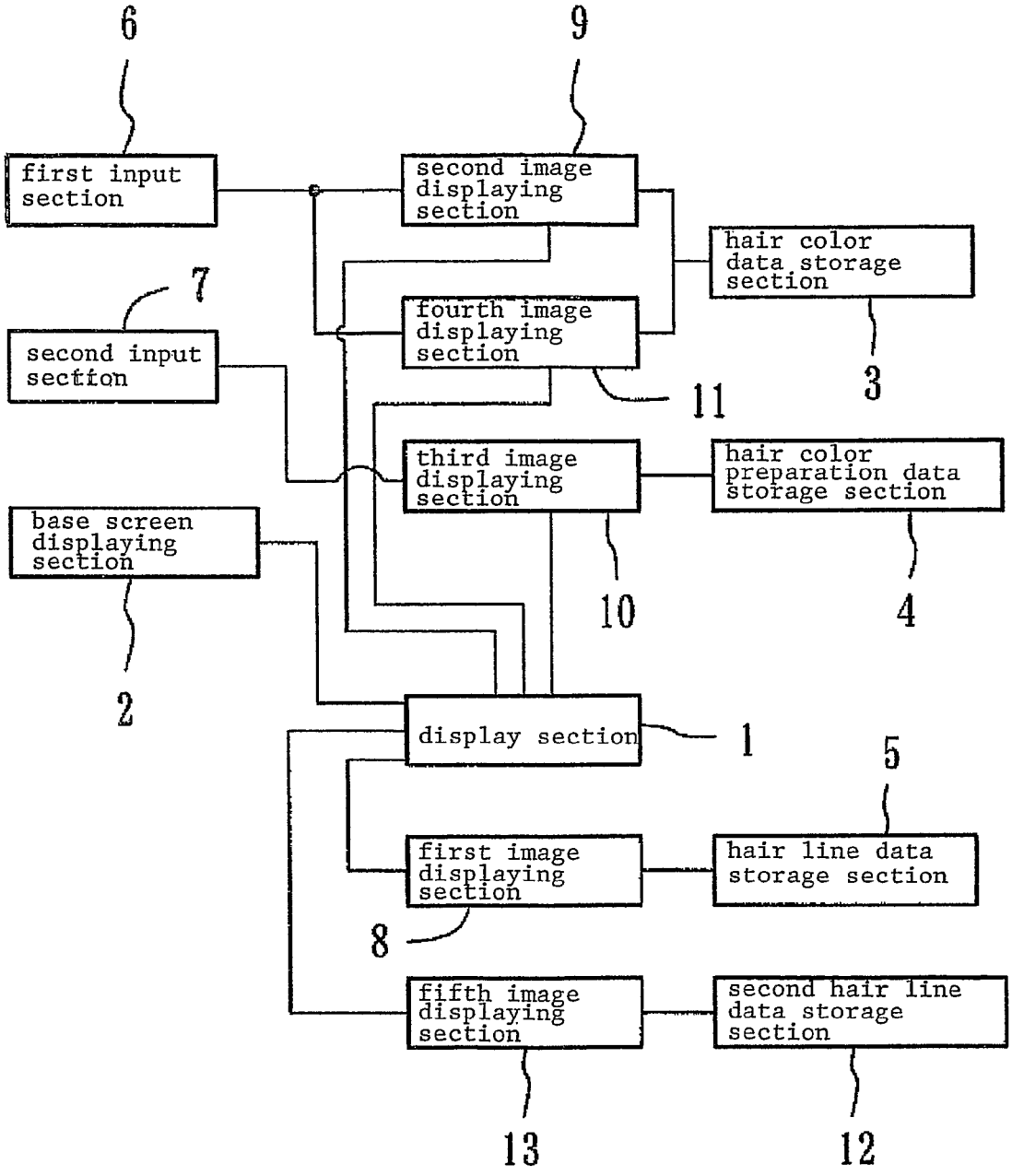
FIG. 1 is a block diagram illustrating the structure of a color simulation system according to a first embodiment of the present invention.

FIG. 1 is a block diagram of a color simulation system according to a first embodiment of the present invention. As shown in FIG. 1, the system according to the present invention includes a display section 1 and a base screen displaying section 2 that displays a base screen having first through fifth layers (in this order from the top) on a predetermined display area of the display section 1.

The system according to the present invention also includes a hair color data storage section 3 in which the RGB value of each of original hair colors to be subjected to hair coloring are stored in advance, a hair color preparation data storage section 4 in which the RGB value of each of the colors of hair color preparations are stored in advance, and a hair line data storage section 5 in which the image data of a hair line are stored in advance. The image of the hair line only shows the dark regions representing the hair, and the rest of the image is transparent.

The system according to the present invention further includes a first input section 6 that receives an input of choice indicating one of the hair colors registered in the hair color data storage section 3, and a second input section 7 that receives an input of choice indicating two hair color preparations selected from the hair color preparations registered in the hair color preparation data storage section 4, together with a mixing ratio between the selected two hair color preparations.

Figure 2:
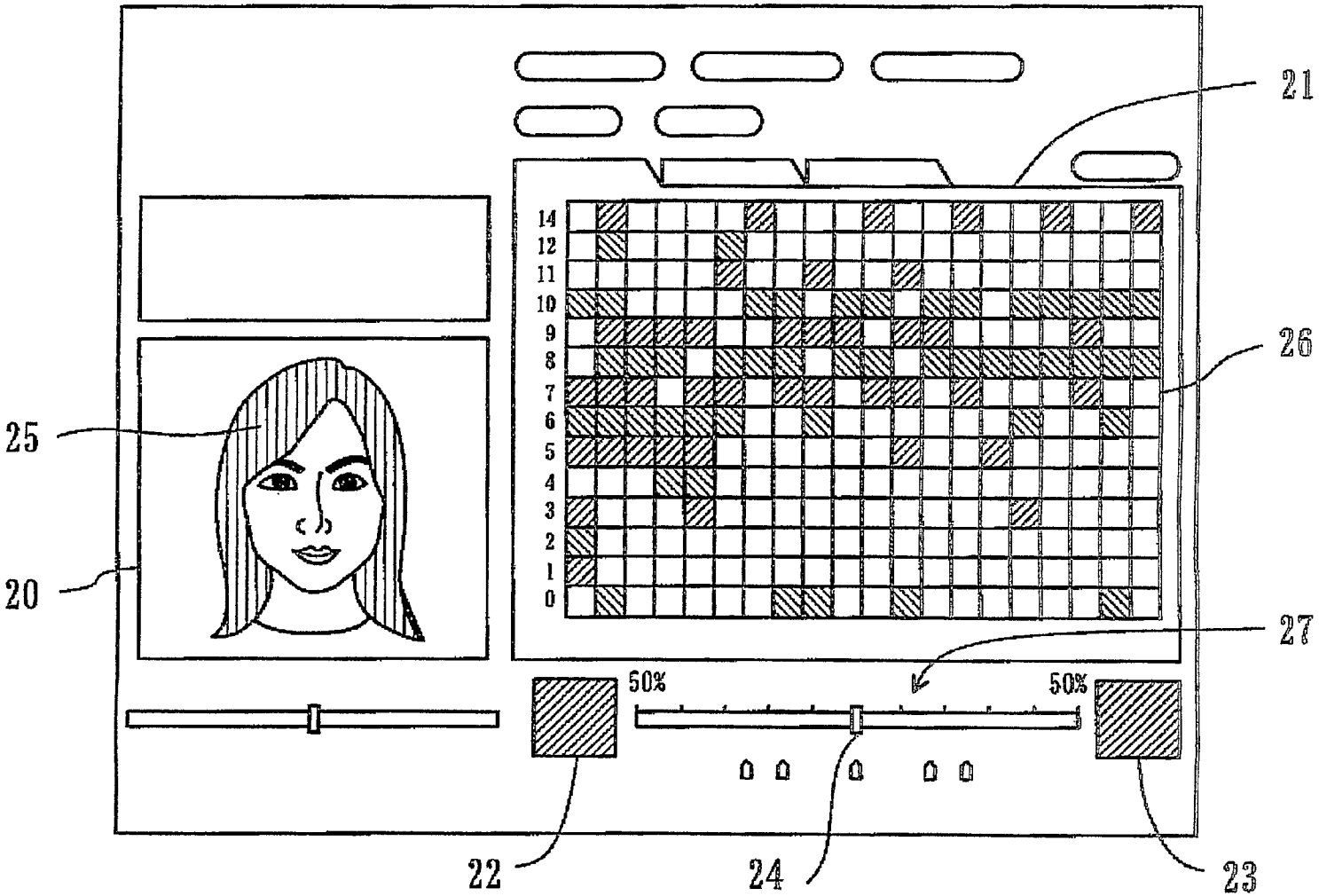
FIG. 2 illustrates the main screen to be displayed on the display section of the system shown in FIG. 1.

FIG. 2 illustrates the main screen displayed on the display section 1 of the system according to the present invention. As shown in FIG. 2, a first display region 20 that is located at the lower left of the screen displays the face of a model. In this embodiment, the base screen displayed by the base screen displaying section 2 is the region in which the image of the hair 25 of the model is shown. Instead of the face of a model, for example, the image of the face of a client that is taken through a suitable image capturing device such as a digital camera, and the image of the hair of the client can be shown on the base screen.

In FIG. 2, a second display region 21 located at the center right of the screen displays a color chart 26. The color chart 26 has a matrix-like format that includes blocks representing the respective colors registered in the hair color data storage section 3 and the hair color preparation data storage section 4. In this embodiment, the first input section 6 is formed with the color chart 26 and a suitable pointing device (not shown) such as a mouse. The block of a desired color shown on the color chart 26 is selected with the mouse, and an input of choice indicating the desired color registered in the hair color data storage section 3 is carried out.

In FIG. 2, at the lower right of the screen, a third display region 22 and a fourth display region 23 are located at a distance from each other in the horizontal direction. A slider 24 that has a scale 27 is displayed between the third display region 22 and the fourth display region 23. In this embodiment, the second input section 7 is formed with the slider 24 as well as the color chart 26 and the mouse that also constitute the first input section 6. The blocks of desired two colors on the color chart 26 are selected with the mouse, and then an input of choice indicating the two hair color preparations among the hair color preparations registered in the hair color preparation storage section 4 is carried out. The colors of the selected two hair color preparations are displayed on the third display region 22 and the fourth display region 23, respectively. Further, the slider 24 is moved with the mouse and is set in a desired position so as to carry out an input of choice indicating the mixing ratio between the selected two hair color preparations. Here, if the slider 24 is located in the middle of the scale 27, the mixing ratio between the two hair color preparations is 1 to 1. In this manner, the mixing ratio between the two hair color preparations is determined by the ratio between the lengths from the slider 24 to both ends of the scale 27.

The system according to the present invention also includes a first image displaying section 8 that displays the corresponding hair line image with predetermined transparency on the first layer of the base screen, based on the image data stored in the hair line data storage section 5. Here, the hair line image may include only one type of image. However, this embodiment is designed to three-dimensionally display each hair image on the display section 1 and give the actual feel of the hair to the hair image displayed on the screen. To do so, a second hair line image that is different from the first hair line image in line pattern and color is superimposed on the first hair line image. Therefore, the base screen displayed by the base screen displaying section 2 has an intermediate layer between the first and second layers, and the system further includes: a second hair line data storage section 12 in which the image data of the second hair line image that is different from the first hair line image in line pattern and color are stored in advance; and a fifth image displaying section 13 that displays the corresponding second hair line image with predetermined transparency on the intermediate layer of the base screen, based on the image data stored in the second hair line data storage section 12.

In this case, the hair line image and the transparency of the color to be displayed on each layer are empirically determined by the values representing the optimum display image. Such values are obtained through a test run of the system and monitoring of the screen displayed on the display section 1.

The system according to the present invention further includes: a second image displaying section 9 that retrieves the RGB value of the selected hair color from the hair color data storage section 3, based on the input received at the first input section 6, and displays the selected hair color without transparency on the fifth layer of the base screen; a third image displaying section 10 that retrieves the RGB values of the selected two hair color preparations from the hair color preparation data storage section 4, based on the input received at the second input section 7, and displays the colors of the selected hair color preparations on the third and fourth layers of the base screen, respectively, with the transparency corresponding to the mixing ratio between the selected hair color preparations; and a fourth image displaying section 11 that retrieves the RGB value of the selected hair color from the hair color data storage section 3, based on the input received at the first input section 6, and displays the selected hair color with predetermined transparency on the second layer of the base screen.

Figure 3:
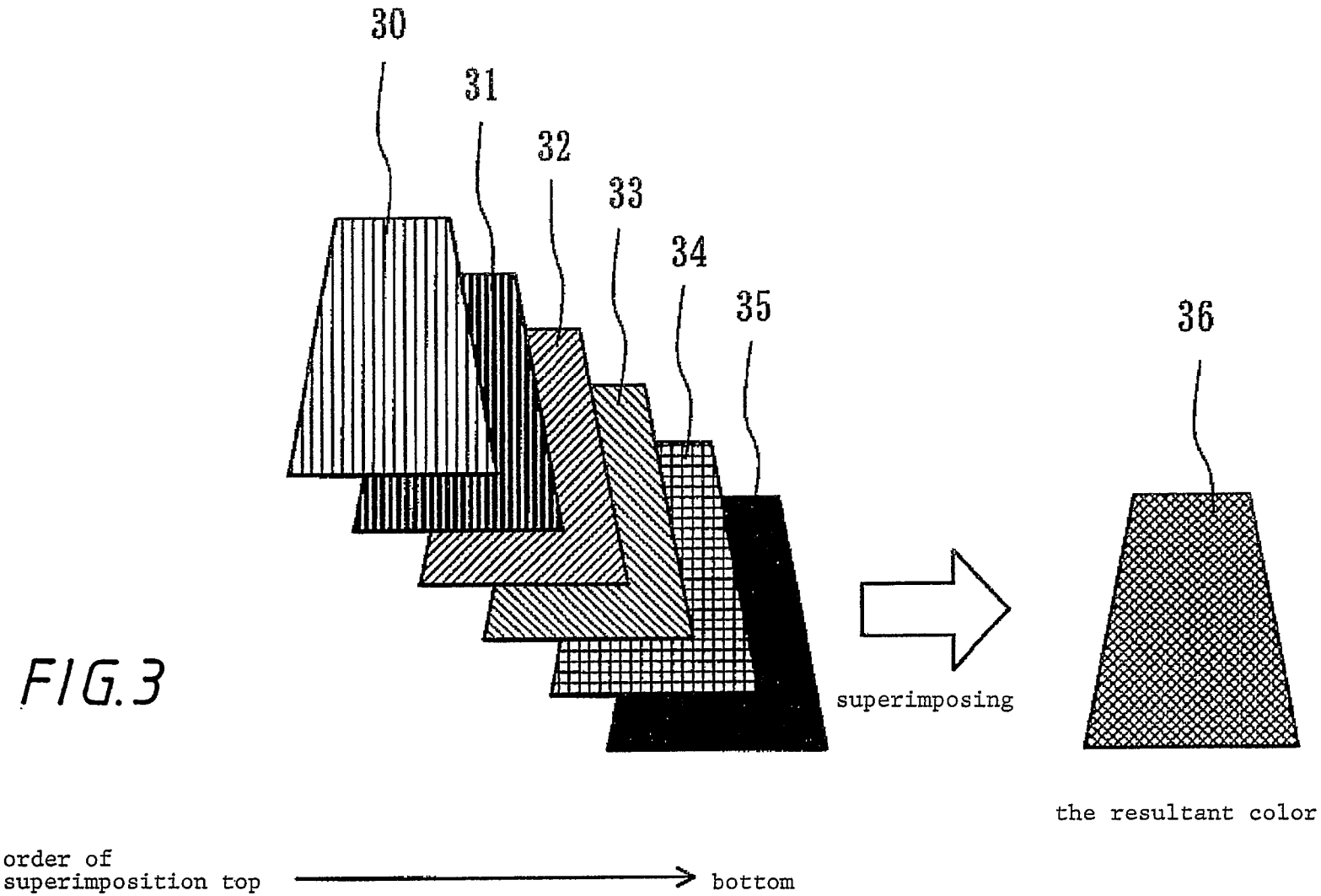
FIG. 3 illustrates the layered structure of the screen of the system shown in FIG. 1.

FIG. 3 illustrates the layered screen displaying process to be carried out by the system according to the present invention. For ease of explanation, the base screen shown in FIG. 3 has the shape of a trapezoid, instead of the shape of the hair line. In FIG. 3, reference numeral 30 indicates the first layer of the base screen, reference numeral 31 indicates the intermediate layer, and reference numerals 32 through 35 indicate the second through fifth layers.

Referring to FIG. 3, the operation of the system according to the present invention is now described briefly. First, the original color of the hair is input to the first input section 6. The first image displaying section 8 then displays the hair line image with the predetermined transparency on the first layer 30. The fifth image displaying section 13 displays the second hair line image with the predetermined transparency on the intermediate layer 31. The second image displaying section 9 displays the selected hair color without transparency on the fifth layer 35. These layers 30, 31, and 35 are then superimposed on one another so as to display the image of the hair in the original hair color on the base screen.

Next, the colors of the two hair color preparations and the mixing ratio between the two hair color preparations are input to the second input section 7. The third image displaying section 10 then displays the colors of the selected hair color preparations with the predetermined transparency on the third layer 33 and the fourth layer 34, respectively, and the fourth image displaying section 11 displays the selected hair color with the predetermined transparency on the second layer 32. All the layers 30 through 35 are then superimposed on one another so as to display the image of the hair in the resultant color of mixing the two hair color preparations on the base screen. Here, the same hair color as the color displayed on the fifth layer 35 is displayed on the second layer 32 and superimposed on the other colors with the predetermined transparency displayed on the other layers, so that a hair color 36 that is very similar to the actual resultant hair color is displayed.

Since the layers (the first layer 30 and the intermediate layer 31), on which the first hair line image and the second hair line image are displayed, are located (on the front side of the display) over the layers (the third layer 33 and the fourth layer 34) on which the colors of the hair color preparations are displayed, the color of the hair displayed on the display section 1 as a result of the superimposition of the layers is more whitish than the actual resultant color. To prevent this problem, the third image displaying section 10 preferably replaces the RGB values representing the colors of the selected two hair color preparations with RGB values that represent darker colors than the original colors of the selected two hair color preparations by predetermined values. By doing so, the colors of the selected two hair color preparations are displayed with the transparency corresponding to the selected mixing ratio on the third and fourth layers 33 and 34, respectively.

The replacing RGB values that represent darker colors than the original colors of the selected hair color preparations are determined so that an optimum display image can be obtained, through a test run of the system and monitoring of the screen displayed on the display section 1.

Also, since the third layer 33 is located over the fourth layer 34 (or on the front side of the fourth layer 34 on the display), the color displayed on the display section 1 as a result of the superimposition of the layers is slightly different from the actual resultant color obtained by mixing the two hair color preparations, with the transparency corresponding to the mixing ratio received at the second input section 7. Therefore, to display a color that approximates to the actual resultant mixed color, the third image displaying section 10 preferably changes the value of the transparency of the color of the hair color preparation to be displayed on the third layer 33 to a lower value, by a predetermined amount, than the value of the transparency determined by the mixing ratio between the selected two hair color preparations. The third image displaying section 10 also preferably changes the value of the transparency of the color of the hair color preparation to be displayed on the fourth layer 34 to a higher value, by a predetermined amount, than the value of the transparency determined by the mixing ratio between the selected two hair color preparations. The third image displaying section 10 then displays the colors of the selected two hair color preparations with the changed transparency on the third and fourth layers 33 and 34, respectively.

The predetermined amount by which the transparency is changed is empirically determined by the values representing an optimum display image that can be obtained through a test run of the system and monitoring of the screen displayed on the display section 1.

In the above described manner, the color simulation system according to the present invention forms a screen with a layered structure. In this system, the hair line image and the original color of hair to be subjected to hair coloring are displayed with predetermined transparency on the corresponding layers. The colors of two hair color preparations to be mixed with each other are also displayed with the transparency corresponding to the mixing ratio between the two hair color preparations on the corresponding layers. Those layers are superimposed on one another so as to display the image of the hair in a color with the feel that is very similar to the actual resultant color of the hair subjected to the hair coloring.

The invention claimed is:

1. A hair color simulation system for simulating a hair coloring procedure in which different hair color preparations corresponding to different hair colors are mixed, said hair color simulation system comprising:

a display section having a predetermined display area;

a base screen displaying section displaying a base screen on the predetermined display area of the display section, the base screen comprising a first layer, an intermediate layer, a second layer, a third layer, a fourth layer, and a fifth layer;

a hair color data storage section recording RGB values of original hair colors to be subjected to hair coloring;

a hair color preparation data storage section recording RGB values of hair colors of hair color preparations;

a first hair line data storage section recording image data of a first hair line;

a second hair line data storage section recording image data of a second hair line which is different in line pattern and color from the first hair line recorded in the first hair line data storage section;

a first input section for receiving an input of a choice of one hair color from the original hair colors recorded in the hair color data storage section;

a second input section for receiving an input of choices of two hair color preparations from the hair color preparations recorded in the hair color preparation data storage section and of a mixing ratio of the selected two hair color preparations;

a first image displaying section displaying the first hair line with a predetermined transparency on the first layer of the base screen according to the image data recorded in the first hair line data storage section;

a second image displaying section retrieving the RGB values of the selected hair color from the hair color data storage section and displaying the selected hair color without transparency on the fifth layer of the base screen based on the input received at the first input section;

a third image displaying section retrieving the RGB values of the selected two hair color preparations from the hair color preparation data storage section and displaying the colors of the selected two hair color preparations with respective transparencies corresponding to the selected mixing ratio thereof on the third layer and the fourth layer of the base screen respectively based on the input received at the second input section;

a fourth image displaying section retrieving the RGB values of the selected hair color from the hair color data storage section and displaying the selected hair color with a predetermined transparency on the second layer of the base screen based on the input received at the first input section;

a fifth image data displaying section displaying the second hair line with a predetermined transparency on the intermediate layer of the base screen according to the image data recorded in the second hair line data storage section; and wherein the first layer, the intermediate layer, the second layer, the third layer, the fourth layer, and the fifth layer of the base screen are superimposed on one another so as to display a resultant simulated hair color that is produced when the first hair line, the second hair line, the colors of the hair color preparations and the original hair color are displayed on the base screen with the respective transparencies and superimposed on each other;

whereby an actual hair color, which results from dyeing hair that has the selected hair color with a mixture of the selected two hair color preparations in the selected mixture ratio, is simulated.

2. The hair color simulation system according to claim 1, wherein the third image displaying section displays deeper colors of the selected two hair color preparations than the colors originally selected from the hair color preparation data storage section with the predetermined ROB values and with the transparency corresponding to the selected mixing ratio thereof.

3. The hair color simulation system according to claim 1, wherein the third image displaying section displays the color of one of the selected two hair color preparations on the third layer with a transparency which is lower than the transparency determined by the selected mixing ratio and the color of the other of the selected two hair color preparations on the fourth layer with a transparency which is higher than the transparency determined by the selected mixing ratio.

4. The hair color simulation system according to claim 1, wherein the display area of the display section represents head hair of a model's face displayed by the display section.

5. The hair color simulation system according to claim 1, wherein the line pattern and the color of the second hair line are selected so that each hair image is three-dimensionally displayed on the base screen to provide a more realistic display.

* * * * *